US009616321B1

(12) United States Patent
Schaap

(10) Patent No.: US 9,616,321 B1
(45) Date of Patent: Apr. 11, 2017

(54) TRADING CARD GAME METHOD OF PLAY WITH INTEGRATED INFORMATIONAL WRIST BADGE GAME COMPONENTS

(71) Applicant: Andrew Cordell Schaap, Dallas, TX (US)

(72) Inventor: Andrew Cordell Schaap, Dallas, TX (US)

( * ) Notice: Subject to any disclaimer, the term of this patent is extended or adjusted under 35 U.S.C. 154(b) by 0 days.

(21) Appl. No.: 14/922,181

(22) Filed: Oct. 25, 2015

(51) Int. Cl.

| | |
|---|---|
| ***A63F 1/02*** | (2006.01) |
| ***A63F 1/00*** | (2006.01) |
| *A63F 1/04* | (2006.01) |
| *A63F 1/06* | (2006.01) |

(52) U.S. Cl.
CPC *A63F 1/00* (2013.01); *A63F 1/02* (2013.01); *A63F 1/06* (2013.01); *A63F 2001/0408* (2013.01); *A63F 2001/0441* (2013.01); *A63F 2001/0475* (2013.01); *A63F 2001/0483* (2013.01); *A63F 2300/807* (2013.01)

(58) Field of Classification Search
CPC ..... A63F 1/06; A63F 2001/0475; A63F 2001/0483; A63F 2001/0408; A63F 2001/0441; A63F 2300/807; A63F 1/02
USPC ..... 273/292, 296, 308, 294, 148 R, 148 A
See application file for complete search history.

(56) References Cited

U.S. PATENT DOCUMENTS

| | | | | |
|---|---|---|---|---|
| 4,869,611 | A * | 9/1989 | Noll | A63F 3/06 401/176 |
| 5,662,332 | A * | 9/1997 | Garfield | A63F 1/00 273/308 |
| 6,322,077 | B1 * | 11/2001 | Braunlich | A63F 1/02 273/292 |
| 6,435,508 | B1 * | 8/2002 | Tavel | A63F 1/00 273/244 |
| 6,601,851 | B1 * | 8/2003 | Sakamoto | A63F 1/00 273/292 |
| 7,258,343 | B2 * | 8/2007 | Hayakawa | A63F 1/00 273/292 |
| 2004/0100021 | A1 * | 5/2004 | Chang | A63F 1/10 273/150 |
| 2006/0097451 | A1 | 5/2006 | Callaway | |

(Continued)

OTHER PUBLICATIONS

U.S. Appl. No. 07/465,333, filed Jan. 16, 1990, Eugene Endrody.

(Continued)

*Primary Examiner* — Benjamin Layno
(74) *Attorney, Agent, or Firm* — Baker Law Firm

(57) ABSTRACT

This invention combines the use of double sided reversible informational wrist badges (badges) with trading card games. The badges are worn on the inside and the outside of the wrist and coupled with the trading cards introduce a further degree of randomness in the game play. The objective of the game is to reduce the health indicator of the other player to zero, where the player is forced to play another character until one player remains with no surviving characters. Badges are utilized in primarily two or more ways, technical data is labeled on each side of the battle badge, the player turns the badge over to show the attribute they wish imbued on their character (such as additional health, strength, aid another character, shields/defense, and offense/attacks). Badges may also be shifted from the front to the back of the wrist to communicate a further degree of game play information.

8 Claims, 3 Drawing Sheets

(56) References Cited

U.S. PATENT DOCUMENTS

| | | | | |
|---|---|---|---|---|
| 2009/0218764 | A1* | 9/2009 | Rosenthal | A63F 1/06<br>273/148 R |
| 2014/0266737 | A1* | 9/2014 | Caldwell | H04Q 9/00<br>340/573.7 |

OTHER PUBLICATIONS

U.S. Appl. No. 12/378,808, filed Feb. 20, 2009, Michel Kuneman.
U.S. Appl. No. 08/942,846, filed Oct. 2, 1997, Kenneth J. Brunelle.
U.S. Appl. No. 06/673,982, filed Nov. 21, 1984, Sigumund F. Seklecki.
U.S. Appl. No. 09/130,680, filed Aug. 6, 1998, Bryson Johnson.

* cited by examiner

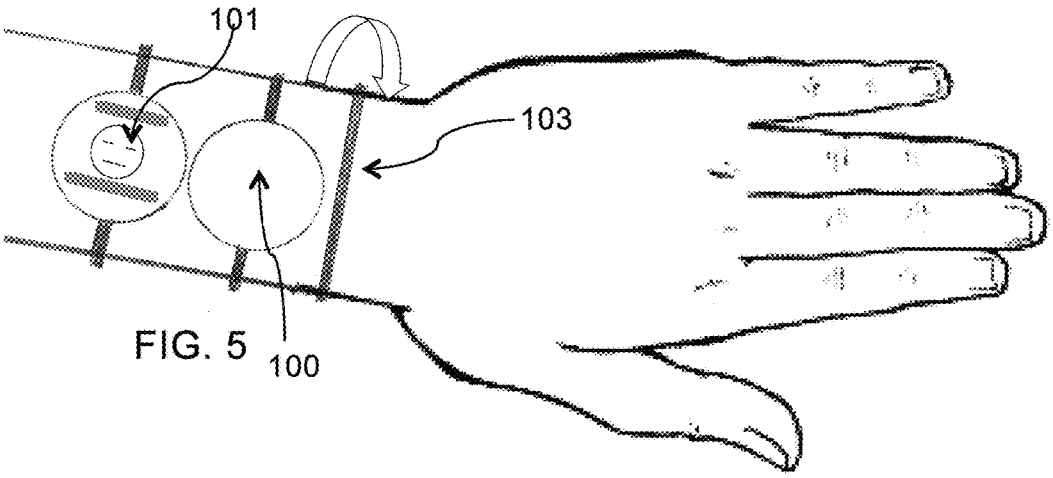
FIG. 5
FIG. 6a
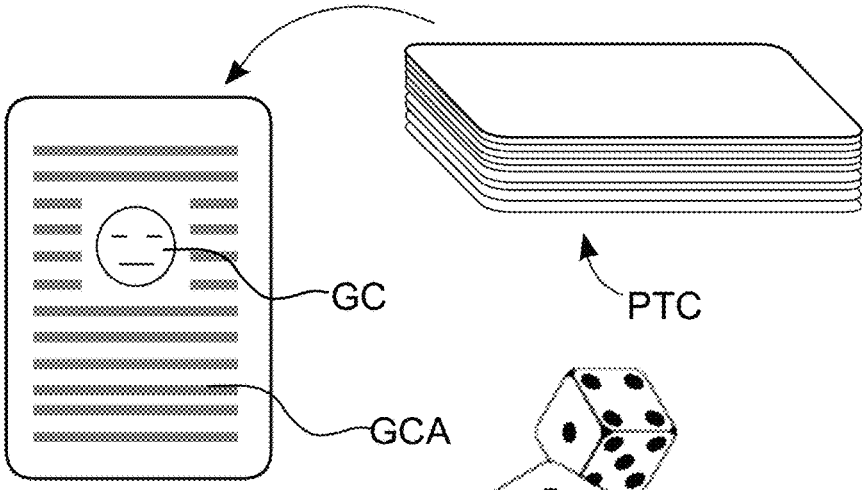
FIG. 6b
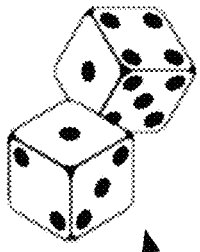
FIG. 6c

TRADING CARD GAME METHOD OF PLAY WITH INTEGRATED INFORMATIONAL WRIST BADGE GAME COMPONENTS

FIELD OF THE INVENTION

The present invention pertains generally to games that combine chance and strategy, and, more particularly, to a trading card game. In the inventor's trading card game a further degree of randomness and required game play calculation, game play memory, and game play strategy are heightened within the game by a plurality of added game components consisting of double-sided reversible informational wrist badges interplayed with trading card game.

BACKGROUND OF THE INVENTION

There are numerous trading cards games. Traditionally these have been associated with public figures such as professional sports athletes, political figures, and recently have been used to identify wanted enemy combatants in war time. Moreover, there are trading cards games that contain fictional characters which provide an element of fantasy and art to the genre.

Trading cards are exchanged between like minded enthusiasts, collectors, traders, sold by merchants, and won in games and tournaments.

Within the inventor's trading card game the added game components of double-sided information wrist badges within the interplay of the trading card game challenges and likely improves the player's cognitive processes and mental dexterity. Further, besides improving game play calculation, memory, math skills, analysis, and strategy skills; the player is given an extra level of excitement and fun factor in the game. Many players will be drawn into the game as they will have an extra opportunity to outwit and out calculate their game opponents.

The position, placement, and rotation of the new double-sided reversible informational wrist badges (badges) affects the interplay within the trading cards during game play.

Regarding the positions of the badges; some embodiments of the invention utilize the double-sided information wrist badges to have one meaning if the badges is on the forearm as opposed to when it is slid around to the inside of the wrist. The Badges are worn either on the interior or the exterior of the wrist using the wristlets. The game play affords both inner arm wear as well as outer arm wear of the badges to utilize disguise and hide the intent of the players, and the use of the badges enabling a high degree of randomness and surprise as the other players cannot see the badge the player intends to utilize during game play.

Regarding the placement of the badges; the badges are positioned on the wrist using the wristlets. The placement of the badge in either the interior or exterior of the wrist indicates the desire of the player to use or not use the specific badge during game play. The positioning of the badges on the interior of the wrist will provide subterfuge of the intent of the player and enabling surprise or hidden attacks and hidden utilization of key powers, energies, defense, offensive, and health benefits that are provided on the badges.

Regarding the rotation of the badges; the badges have two primary rotation possibilities. First, in various embodiments, rotation of the badges by turning them over and revealing new attributes that the player wishes to employ, such as powers, energies, defenses, offense and health benefits. In such cases, players may choose to hide all the badge attributes prior to game play by turning the badges over with the back side facing out. In other embodiment of the game play scenarios the badges will all back side facing out with the one selected to be turned out. In some embodiments, both sides of the Badges may contain information that add to or change the dynamic of the game play. Second, the Rotation of the Badges may include moving the badge(s) from one side of the wrist to the other. for example, in one embodiment, the players may employ the added character strengths by turning the badge to the interior of the wrist or vise versa to the exterior of the wrist.

SUMMARY

The present invention is directed to a method of game play combining the use of double sided reversible informational wristlet badges with trading card games. The badges are worn on the inside or the outside of the wrist and coupled with the trading cards introduce a further degree of randomness in the game play. In some embodiments when the badges are shifted from the outside of the wrist to the inside of the wrist those informational badges will communicate different information in the game play even further increasing the game permutations, and combination demanding higher game player analysis.

In one embodiment of the method of game play the objective is to reduce the health indicator of the other player to zero, where the player is forced to play another character until one player remains with no surviving characters. In this embodiment, badges are utilized in primarily two or more ways, technical data is labeled on each side of the battle badge, the player turns the badge over to show the attribute they wish imbued on their character (such as additional health, strength, aid another character, shields/defense, and offense/attacks). Badges may also be turned by shifting the labeled badge from the front to the back of the wrist.

Factors and Aspects of the Invention

The inventor is not aware of trading card games having a interplay of playing cards and double-sided reversible informational badges directly tied into the games rules.

In one embodiments of this invention allows the wristlet double-sided reversible informational badges to be shifted from the outside of the wrist to the inside of the wrist communicating different information in the game play even further increasing the game permutations, and combination demanding higher game player analysis.

In another embodiment of the method of playing invention which the inventor names "random fire game play", each player has access to a reservoir of tradeable game components, including a plurality of trading cards and a plurality of wrist badges. The reservoir of tradeable game components is comprised of multiple copies of unique individual game components. In this embodiment of the method of play, the trading cards when played are thereby represented as battle cards and the double sided informational wrist badges when played are thereby represented as battle badges. Directions and rules are as follows:

1). Both the trading cards and wrist badges are all shuffled face down with the card game characters and associated characteristics hidden.

2). Each player draws an equal number of random trading cards.

3). The players proceed to attack by each player choosing which battle badge to play and each player simultaneously lays down the battle card down.

4). If a player draws the same identity of the battle card and battle badge, that player can use the battle badge to increase his attack damage and the players health strength by turning the battle wrist badge facing up on the forearm of the wrist prior to starting the game.

5). All non-used double sided informational wrist badges should be face down.

6). Each player is directed to hide his battle badge from those of his opponents to be later used as a surprise attack and to have advantage.

7). Battle badges can be used only once per game by turning the double sided informational wrist badges face up on the players wrist at any time during the game.

8). The players should hide their double sided informational wrist badges from the opposing player's in order to have an element of surprise using the additional health strength and attack damage in an attack.

9). The energy, combat, and revolution badges can be used as a surprise attack upon the opposing players any time during the game.

10). The game play with the last battle badge wins.

In another embodiment of the method of playing invention which the inventor names random fire game play each player has access to a reservoir of tradable game components, including a plurality of trading cards and a plurality of wrist badges. The reservoir is comprised of multiple copies of unique individual game components. In this embodiment of the method of play the trading cards are played and represented as "battle cards" and the wrist badges are played and represented as "battle badges." The method of play for this embodiment of the invention is called "Max Attacks Game Play" by the inventor and directions and rules are as follows:

1). In this battle card game each player must pick from the reservoir of game components a battle badge character to fight with.

2). If after picking a battle badge character that player must pick a different battle card characters to fight with.

3). To attack in this embodiment of the invention the player chooses the attack he/she wishes to use and evaluates the health level of his opponents game character. Afterwards, the player then subtracts however much the attack was worth taking turns attacking until the battle card characters dies. The attack continues until one of the battle card characters is defeated.

4) Battle Training Badges: Once per game a player can use a battle training badge which will add additional Health levels and additional attack damage levels on the player's battle badges.

5). The player can use a wrist battle training badge by simply declaring the player is going to use it and then turns the battle training badge over to show and active the battle card characteristics such as the game character name, the added health levels, and the added attack damage levels. Optionally the player can declare the battle training badge at the start of the game adding the corresponding game characters health level and attack damage level to the particular battle care characteristics.

6). The rules allow for the energy badges to be special badges that allow the player's game character to be more potent as far as health levels and attack levels than battle badges do.

7). To use energy badges the player applies the energy badges as they do the battle badges. The energy badges can be only used one time per game however energy badges can be used anytime during the game to surprise the opponent.

8). The last player with a playing battle card character(s) living wins.

It is also contemplated that the present invention can be used on existing and readily available electronic devices, virtual reality electronic devices, such as computers, video games, electronic games, and on interactive networks utilizing computer software and text.

Such electronic devices can visually display the cards and enable the players to manipulate the cards and badges and execute turns as describer hereinabove. Commercially available electronic communication devices can also be provided to enable players to communicate with each other over long distances.

For at least the foregoing reasons, there is a need for a method of trading card game playing that utilizes a plurality of double-sided reversible informational wristlet badges interplayed with trading card games which introduces a further degree of randomness and required game play calculation, analysis, memory, and strategy.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

FIG. 1 is a perspective view illustrating an embodiment of the method of play in a relaxed and starting game position showing three double-sided reversible informational wrist badges.

FIG. 2 is a perspective view illustrating an embodiment of the method of play using three double-sided reversible informational wrist badges showing the wrist badges being rotated while worn on the wrist.

FIG. 3 is a perspective view illustrating an embodiment of the method of play in a relaxed and starting game position with three double-sided reversible informational wrist badges with two wrist badges worn on the outside of the forearm and one wrist badge being worn on the inside of the forearm.

FIG. 4 is a perspective view illustrating a wrist badge being slid from being worn on the outside of the forearm to being worn on the inside of the forearm.

FIGS. 5, 6*a*, 6*b* and 6*c* show respectively, a perspective view illustrating how a wrist badge has the ability to slide from the inside of the forearm to the outside of the forearm, a plurality of trading cards in a deck (PTC), a trading card turned face up showing a generic game character (GC) and game character attributes (GCA), and a pair of dice.

REFERENCE LISTING OF THE NUMBERED ELEMENTS

100 Double-sided Informational reversible wrist badge.
101 Bottom side of the double-sided informational reversible wrist badge.
102 Top side of the double-sided informational reversible wrist badge.
103 Wristlet having wrist badge attached to it.
104A player's wrist.

DESCRIPTION OF THE FIGURES

Referring generally to FIG. 1, the wrist badges 102 of an embodiment of the method of play are shown in a relaxed and starting game position. Each wrist badge 102 is shown attached to a wristlet 101. The wrist badges are affixed to the player's wrist using a bracelet 101 that allows enough slack for the wrist badge 102 to turn and rotate around the player's wrist 104. Referring generally to FIG. 2 and FIG. 3 the double-sided reversible informational wrist badges can be turned over activating new game play information. The badges display information on both sides that provide game information not limited to modifications of a player's character(s) existing strengths, health and other abilities. Referring to FIG. 4 and FIG. 5 the wrist badges 102 are able to slide from the inside of the wrist to the outside of the wrist and vise versa. When this occurs new game play information is activated and or deactivated according to the game rules of the embodiment of the method of play.

Figure 1:
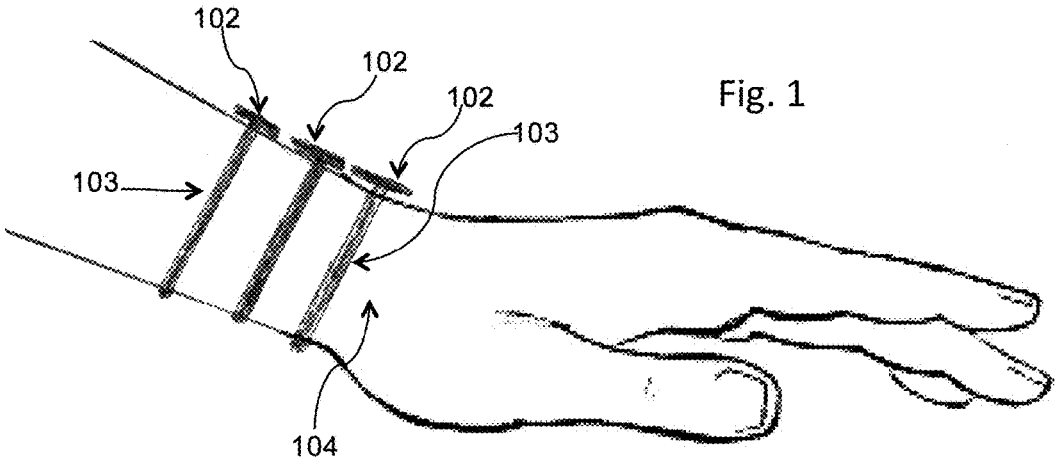
Figure 2:
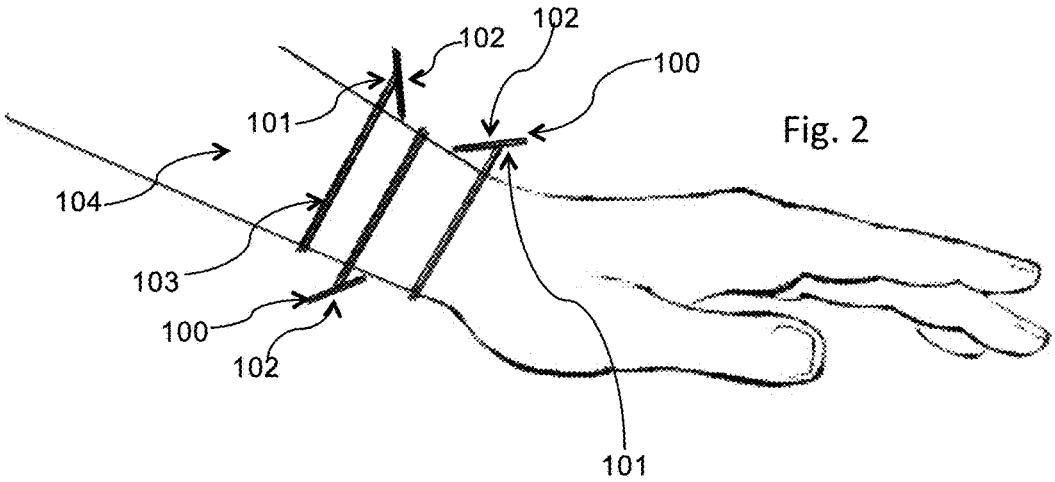
Figure 3:
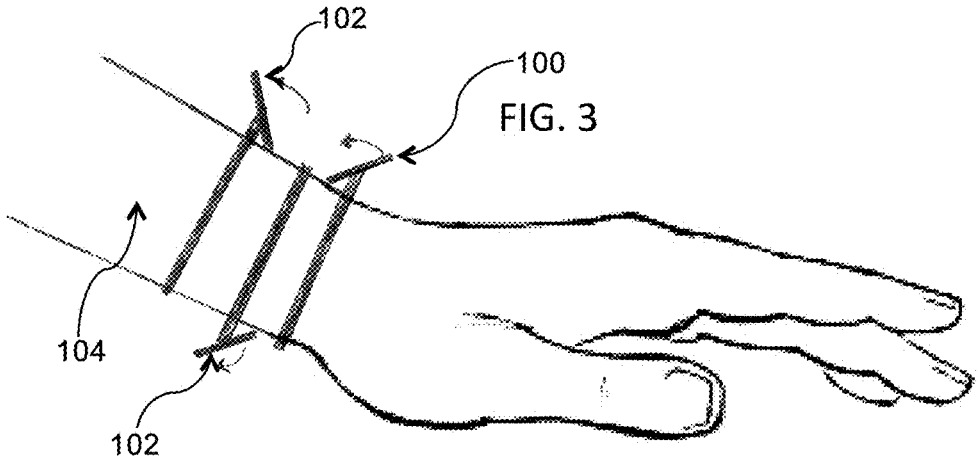
Figure 4:
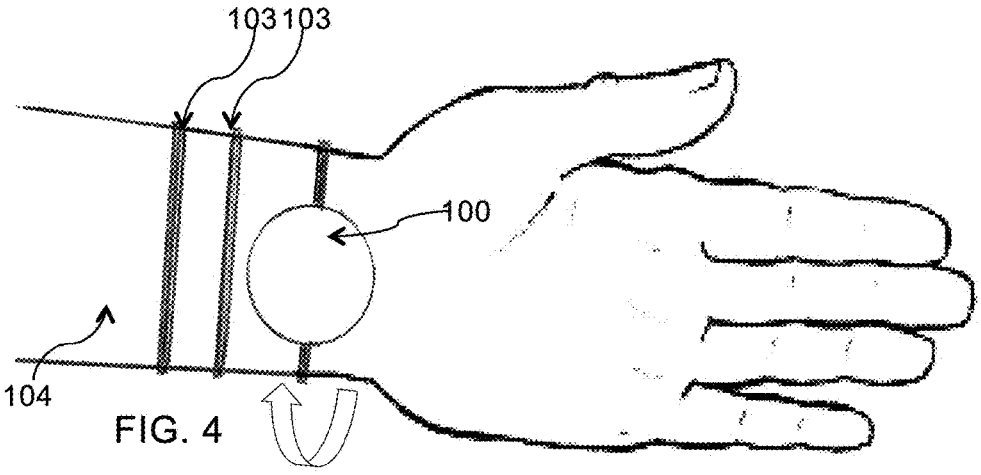

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

DEFINITIONS

In the following description, the term "wrist badge" as used herein, means a double-sided reversible informational game component worn on the wrist in which the information is integrated into the game play.

In the following description, the term "wristlet" as used herein, means a band or material worn around or on the wrist to hold the wrist badges.

In the following description, the term "a band or material" as used herein, means any material that is commercially available today used as a wristlet or bracelet.

In the following description, the term "badge turn" as used herein, means that the double-sided reversible informational wrist badge is turned over with new game information in an activate state as opposed to the inactive state it was in.

In the following description, the term "game character or playing battle card character" as used herein, means an imaginary person represented in a work of fiction.

In the following description, the term "health strength" as used herein, means each game character has a health strength that is identified on the battle cards, the individual game characters have different health strength levels.

In the following description, the term "surprise or surprise attack" as used herein, means each game the players has the ability to surprise their opponent's characters with additional strength, health, weapons and defensive capabilities that are contained on the random battle badges.

In the following description, the term "attack or to attack" as used herein, means attack is when one character on one team utilizes one of their attack methods outlined on the game card. Each character has an identified attack strength identified on the battle card.

In the following description, the term "attack strength" as used herein, means attack strength identified on the battle card for the particular game character.

In the following description, the term "attack damage" as used herein, means attack damage is sustained when one character utilizes their attack method against another character from an opposing team. The reduction in Health Strength is commensurate with the attack strength.

In the following description, the term "defensive capabilities" as used herein, referrers to game characters that have additional levels of health strength, overall strength, and characteristics such as pr vided aid another character, shields, defenses, offenses and attacks.

In the following description, the term "battle cards" as used herein, means the game character which are represented on the battle cards, including information of the game character's health strength, attack types, attack strengths, any alliances, or to the group in which belong to, special skills and capabilities. Player's use the battle cards as a guide to decide on attacks and calculate the damages from the other player's attacks.

In the following description, the term "game characters or game characters game play attributes" as used herein, means the individual game character's game play attributes of health strength level, attack types available, attack strength level, offensive and defensive attributes, any alliances to other game characters, or to the group in which the game character belongs and any special skills and capabilities.

In the following description, the term "battle badge" as used herein, means the game character which are represented on the battle cards, including information such as the game character's health strength, attack types, attack strengths, any alliances, or to the group in which the character belongs to, or any of the characters special skills and capabilities.

In the following description, the terms "energy badges or combat badges, or revolution badges" as used herein, all have the same characterizes of battle badges but are not specific to an individual character and can provide additional strength, attack damage, weapons, offensive, and defensive capabilities. An analogy of using energy badges it is like eating a fictional training power bar rather than training in real life for four hours or so.

In the following description, the terms "defeated" as used herein, means when the game character's health level has been reduced to zero.

In the following description, the terms "rock-paper-scissors" is a zero sum hand game usually played between two people, in which each player simultaneously forms one of three shapes with an outstretched hand. These shapes are "rock" (a simple fist), "paper" (a flat hand), and "scissors" (a first with the index and middle fingers together forming a V). Rock wins between rock and scissors, paper wins between rock and paper, rock wins between rock and scissors, scissors wins between scissors and paper. As used herein, the term "dice" corresponds to the ordinary definition of the term: i.e., a small cube with each side having a different number of spots on it, ranging from one to six, thrown and used in gambling and other games involving chance.

What is claimed is:

1. A method of trading card playing games involving two or more players, the method being suitable for games having rules for game play that include instructions on drawing, playing, and discarding game components, comprising the steps of:

providing a plurality of double-sided reversible informational wrist badges having indicia representing individual game characters and having indicia representing corresponding game character's game attributes providing a plurality of wristlets for attaching the wrist badges thereon;

wherein each double-sided reversible informational wrist badge of the plurality of double-sided reversible informational wrist badges have one meaning if the double-sided reversible informational wrist badges are attached to the wristlets and are worn on the game player's forearm as opposed to when the double-sided reversible informational wrist badges are worn on the game player's inside of the wrist;

shuffling a plurality of trading cards, and placing the double-sided reversible informational badges face down wherein at least some character game play attributes of the double-sided reversible informational badges are hidden from each player's view;

each player constructing his or her own hand of an equal number of double-sided reversible informational wrist badges by examining and selecting which double-sided reversible informational wrist badges represent a game character the player chooses to play and then simultaneously laying down that player's chosen game character's associated trading card, which defines a played battle card;

each player places his or her selected double-sided reversible informational badges on his or her wrist via one or more wristlets;

each player executes turns in sequence with other players by drawing, playing, and discarding one or more double-sided reversible informational wrist badges or one or more trading cards in accordance with the game rules until the game ends;

bringing into play the one or more double-sided reversible informational wrist badges which define one or more battle badges by:

(i) a player pointing to a double-sided reversible informational wrist badge on his or her wrist; and (ii) a player turning over a double-sided reversible informational wrist badge on his or her wrist; and (iii) a player sliding a double-sided reversible informational wrist badge from the inside of his or her wrist to the outside of his or her wrist; and (iv) a player sliding a double-sided reversible informational wrist badge from the outside of his or her wrist to the inside of his or her wrist.

2. The method according to claim 1 wherein the first step comprises the players throwing dice with a high die of the dice taking the first turn.

3. The method according to claim 1 wherein the first step comprises the players playing rock-paper-scissors and a winner taking the first turn.

4. The method according to claim 1 wherein bringing into play the one or more battle badges can be accomplished by shifting the double-sided reversible informational wrist badge from the left arm wrist to the right arm wrist or vice versa.

5. A method of trading card playing games involving two or more players, the method being suitable for games having rules for game play that include instructions on drawing, playing, and discarding game components, comprising the steps of:

providing a plurality of double-sided reversible informational wrist badges having indicia representing individual game characters and having indicia representing corresponding game character's game attributes providing a plurality of wristlets for attaching the wrist badges thereon;

wherein the double sided reversible informational wrist badges having one meaning if the double-sided reversible informational wrist badges are attached to the wristlets and are worn on the game player's forearm as opposed to when the double-sided reversible information wrist badges are worn on the game player's inside of the wrist, and the double sided reversible information wrist badges having one meaning if the double-sided reversible informational wrist badges are worn on the game player's right forearm as opposed to when the double-sided reversible information wrist badges are worn on the game player's left forearm;

shuffling the plurality of trading cards and placing the double-sided reversible informational wrist badges face down wherein at least some character game play attributes of the double-sided reversible informational wrist badges are hidden from each player's view;

each player constructing their own hand of an equal number of double-sided reversible informational wrist badges by examining and selecting which double-sided reversible informational badge represents a game character the player chooses to play and then by simultaneously laying down that player's chosen game character's associated trading card, which when played defines battle card;

each player places his or her selected double-sided reversible informational badges on his or her wrist via one or more wristlets;

each player executes turns in sequence with other players by drawing, playing, and discarding in accordance with the game rules until the game ends;

bringing into play one or more double-sided reversible informational wrist badges which define one or more battle badges by:

(v) a player pointing to a double-sided reversible informational wrist badge on his or her wrist; and (vi) a player turning over a double-sided reversible informational wrist badge on his or her wrist; and (vii) a player sliding a double-sided reversible informational wrist badge from the inside of his or her wrist to the outside of his or her wrist; and (viii) a player sliding a double-sided reversible informational wrist badge from the outside of his or her wrist to the inside of his or her wrist.

6. The method according to claim 5 wherein the first step comprises the players throwing dice with a high die of the dice taking the first turn.

7. The method according to claim 5 wherein the first step comprises the players playing rockpaper-scissors and a winner taking the first turn.

8. The method according to claim 5 wherein bringing into play one or more battle badges can be accomplished by shifting the double-sided reversible informational badge from the left arm wrist to the right arm wrist or vice versa.

* * * * *